US009232613B2

(12) United States Patent
Ebihara et al.

(10) Patent No.: US 9,232,613 B2
(45) Date of Patent: Jan. 5, 2016

(54) LIGHT-EMITTING DEVICE, METHOD OF CONTROLLING LIGHT-EMITTING DEVICE, AND PROGRAM

(71) Applicant: Sony Corporation, Tokyo (JP)

(72) Inventors: Hidekazu Ebihara, Kanagawa (JP); Takeshi Niikura, Kanagawa (JP); Satoshi Kawabe, Saitama (JP); Akihiro Ogata, Saitama (JP); Hideaki Kushida, Saitama (JP); Satoshi Nagasawa, Tokyo (JP); Shinnosuke Oguma, Saitama (JP); Takashi Yamazaki, Saitama (JP)

(73) Assignee: SONY CORPORATION, Tokyo (JP)

( * ) Notice: Subject to any disclaimer, the term of this patent is extended or adjusted under 35 U.S.C. 154(b) by 258 days.

(21) Appl. No.: 13/788,263

(22) Filed: Mar. 7, 2013

(65) Prior Publication Data

US 2013/0241432 A1 Sep. 19, 2013

(30) Foreign Application Priority Data

Mar. 13, 2012 (JP) ..... 2012-055756

(51) Int. Cl.
*H05B 37/02* (2006.01)

(52) U.S. Cl.
CPC ..... *H05B 37/0272* (2013.01)

(58) Field of Classification Search
CPC ..... H05B 37/02; H05B 37/0272; H05B 37/0281; H05B 33/0842; H05B 33/0845; H05B 33/0863
USPC ..... 315/224, 225, 226, 291, 294, 307; 340/5.61, 5.62, 5.63, 5.64, 870.11, 340/870.15
See application file for complete search history.

(56) References Cited

U.S. PATENT DOCUMENTS

| | | | | |
|---|---|---|---|---|
| 6,617,977 | B1 * | 9/2003 | Nakao | 340/870.11 |
| 9,035,568 | B2 * | 5/2015 | Ganton et al. | 315/291 |
| 2005/0047134 | A1 * | 3/2005 | Mueller et al. | 362/231 |
| 2012/0140601 | A1 * | 6/2012 | Nakagawa | 368/10 |

* cited by examiner

*Primary Examiner* — Thai Pham
(74) *Attorney, Agent, or Firm* — Frommer Lawrence & Haug LLP; William S. Frommer; Ellen Marcie Emas

(57) ABSTRACT

There is provided a light-emitting device including a wireless communication unit that performs wireless communication with another device, a light-emitting unit that emits light, and a control unit that performs control by switching between a mode in which the light emission of the light-emitting unit is controlled in accordance with a timing at which a signal is received by the wireless communication unit and a mode in which the light emission of the light-emitting unit is controlled in accordance with an internal timer based on a light emission timing included in a signal received from the other device by the wireless communication unit.

5 Claims, 13 Drawing Sheets

LIGHT-EMITTING DEVICE, METHOD OF CONTROLLING LIGHT-EMITTING DEVICE, AND PROGRAM

BACKGROUND

The present disclosure relates to a light-emitting device, a method of controlling the light-emitting device, and a program.

According to the related art, for example, JP 2009-70832A discloses a technology in which a transmitter transmits at least one lighting control signal based on a map file to a plurality of light systems and at least first and second light systems of the plurality of light systems each generate an optical output in response to at least one lighting control signal so that a visibly linked effect can be obtained by visible light including letters, figures, visual patterns, and pictures.

SUMMARY

In a concert hall or the like, a visible effect can be improved by blinking the penlights used by audience members. However, it is difficult to completely coordinate the timings at which several thousands of penlights or several tens of thousands of penlights used in a concert hall turn on and off.

When penlights individually blink in a concert hall or the like, a sense of unity of audience members may not be obtained. Further, as disclosed in JP 2009-70832A, if the timings at which the penlights turn on and off are shorter when the penlights are turned on and off in response to a lighting control signal, traffic increases. Therefore, there is a problem that occupation of wireless channels may increase.

It is desirable to provide a technology for coordinating the timings at which a plurality of slave devices turn on and off and also suppressing an increase in traffic.

According to an embodiment of the present disclosure, there is provided a light-emitting device including a wireless communication unit that performs wireless communication with another device, a light-emitting unit that emits light, and a control unit that performs control by switching between a mode in which the light emission of the light-emitting unit is controlled in accordance with a timing at which a signal is received by the wireless communication unit and a mode in which the light emission of the light-emitting unit is controlled in accordance with an internal timer based on a light emission timing included in a signal received from the other device by the wireless communication unit.

Further, The control unit controls the light emission of the light-emitting unit in accordance with the timing at which a signal is received by the wireless communication unit when a light emission period included in the signal received from the other device is equal to or greater than a predetermined value, and the control unit controls the light emission of the light-emitting unit in accordance with the internal timer when the light emission period is less than the predetermined value.

Further, the control unit may control the light emission of the light-emitting unit by fade-in or fade-out.

Further, the light-emitting device may further include an operational input unit that receives an input operation. The control unit may control the light emission of the light-emitting unit in accordance with an input to the operational input unit when the wireless communication unit does not receive a signal from the other device.

Further, according to an embodiment of the present disclosure, there is provided a method of controlling a light-emitting device including performing wireless communication with another device, determining a light emission period included in a signal received from the other device, controlling light emission of a light-emitting unit in accordance with a timing at which a signal is received through wireless communication when the light emission period is equal to or greater than a predetermined value, and controlling the light emission of the light-emitting unit in accordance with an internal timer when the light emission period is less than the predetermined value.

Further, according to an embodiment of the present disclosure, there is provided a program for causing a computer to execute performing wireless communication with another device determining a light emission period included in a signal received from the other device, controlling light emission of a light-emitting unit in accordance with a timing at which a signal is received through wireless communication when the light emission period is equal to or greater than a predetermined value, and controlling the light emission of the light-emitting unit in accordance with an internal timer when the light emission period is less than the predetermined value.

According to the embodiments of the present disclosure, it is possible to coordinate the timings at which a plurality of slave devices turn on and off and also suppress an increase in traffic.

DETAILED DESCRIPTION OF THE EMBODIMENTS

Figure 1:
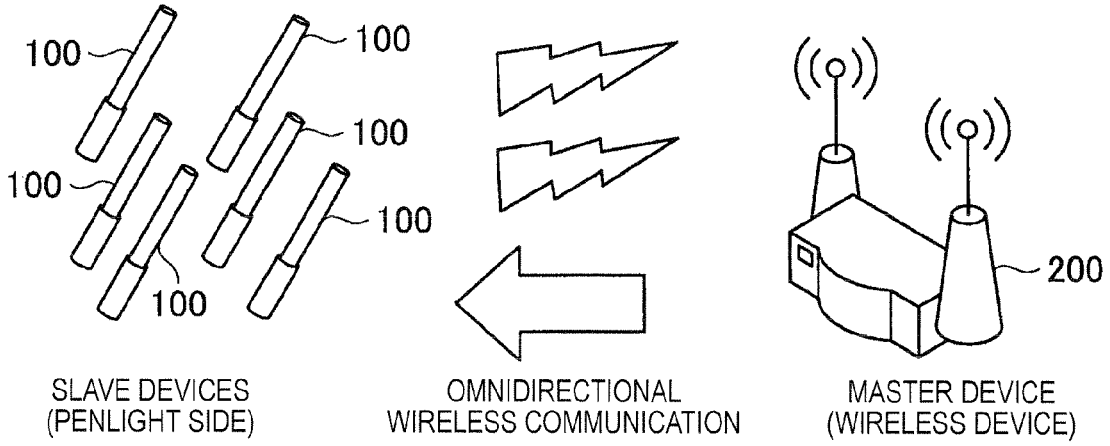
FIG. 1 is a sectional view illustrating the overall configuration of a system according to an embodiment of the present disclosure.

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

The description will be made in the following order.

1. Overview of System
2. Example of Configuration of Slave Device
3. Example of Configuration of Master Device
4. Transmission Data in Master Device
5. Transmission Packet from Master Device
6. Control of Turn-on and Turn-off Time
7. Two Modes in Which Turn-on and Turn-off Time Is Controlled
8. Processing Flow of Embodiment
9. Control by Clock Inside Slave Device
10. Control in Accordance with Audio Level and Frequency of Song
11. Function of Proceeding to Manual Mode

[1. Overview of System]

First, the overall configuration of a system according to a first embodiment of the present disclosure will be described with reference to FIG. 1. As shown in FIG. 1, the system according to this embodiment includes slave devices (penlights) 100 and a master device (a wireless device and a server) 200. Here, a case in which audience members use penlights as the slave devices 100 in a concert hall or the like will be exemplified, but embodiments of the present disclosure are not limited thereto. The slave devices 100 and the master device 200 are configured to perform wireless communication. The master device 200 transmits signals to the slave devices 100 through omnidirectional wireless communication. By transmitting the signals from the master device 200 to the slave devices 100, turn-on and turn-off timings, emission colors, luminances, and the like of the slave devices 100 can be controlled.

[2. Example of Configuration of Slave Device]

Figure 2:
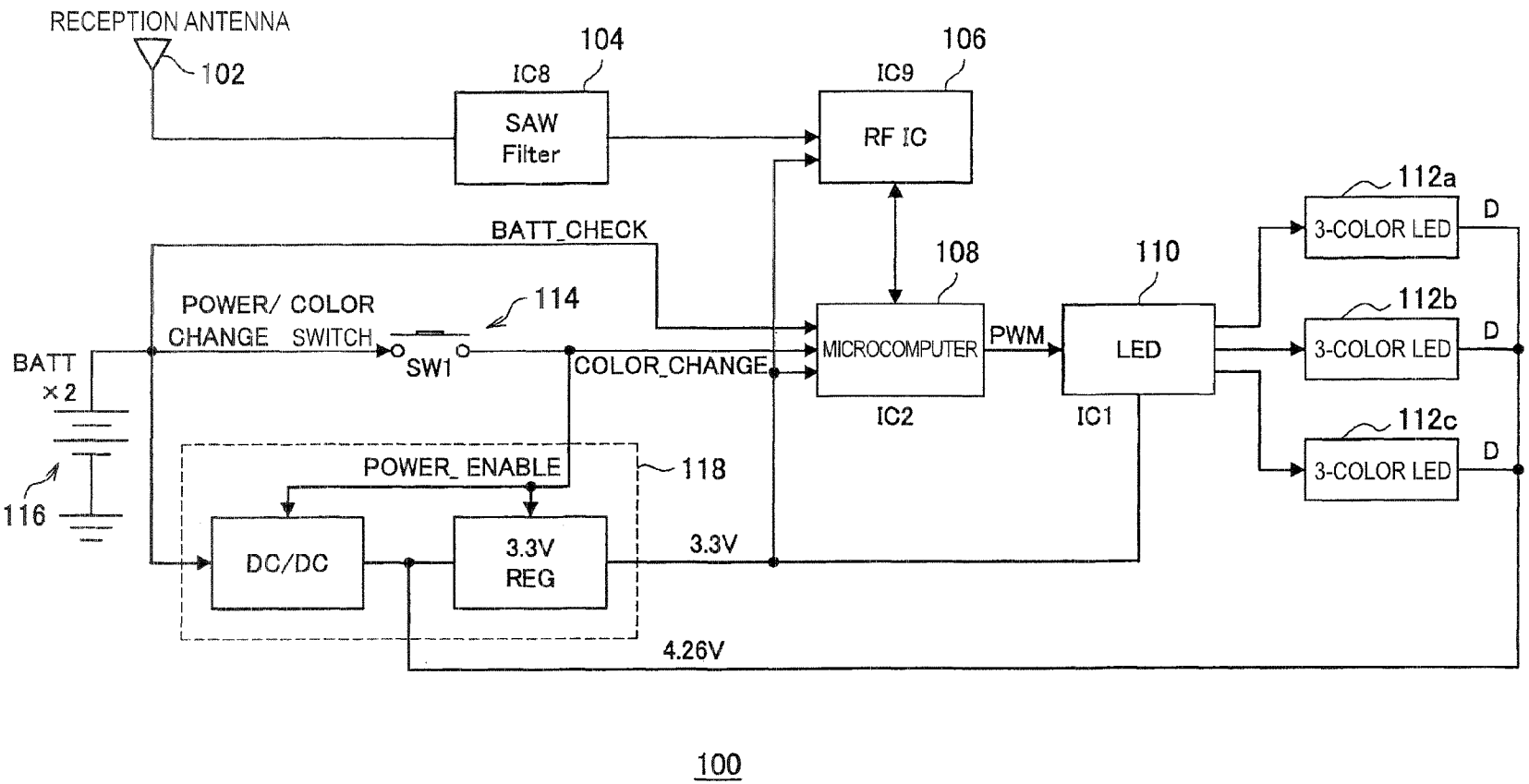
FIG. 2 is a schematic diagram illustrating the configuration of a slave device.

FIG. 2 is a schematic diagram illustrating the configuration of the slave device 100. As shown in FIG. 2, the slave device 100 includes a reception antenna 102, a filter 104, an RF_IC 106, a control unit (CPU) 108, an LED driver 110, 3-color LEDs 112*a*, 112*b*, and 112*c*, a switch 114, a battery 116, and a power unit 118.

The antenna 102 receives a signal transmitted from the master device 200. The filter 104 removes an unnecessary component from the signal received by the antenna 102. The RF_IC 106 extracts a command included in the signal received from the master device 200 and transmits the command to the control unit 108.

The control unit (CPU) 108 transmits an instruction to drive the 3-color LEDs 112*a*, 112*b*, and 112*c* to the LED driver 110 based on the command included in the signal received from the master device 200. The LED driver 110 drives the 3-color LEDs 112*a*, 112*b*, and 112*c* based on the instruction transmitted from the control unit 108. Thus, the emission colors, luminances, blinking intervals, and the like of the 3-color LEDs 112*a*, 112*b*, and 112*c* are controlled in accordance with the command transmitted from the master device 200.

The switch 114 transmits a command to give an instruction of the emission colors, the luminances, the blinking intervals, and the like of the 3-color LEDs 112*a*, 112*b*, and 112*c* to the control unit 108 in response to a manual operation of a user. The battery 116 is a power source that supplies power to each constituent unit of the slave device 100. The power of the battery 116 is supplied to the RF_IC 106, the control unit 108, the LED driver 110, and the 3-color LEDs 112*a*, 112*b*, and 112*c* by the power unit 118.

[3. Example of Configuration of Master Device]

Figure 3:
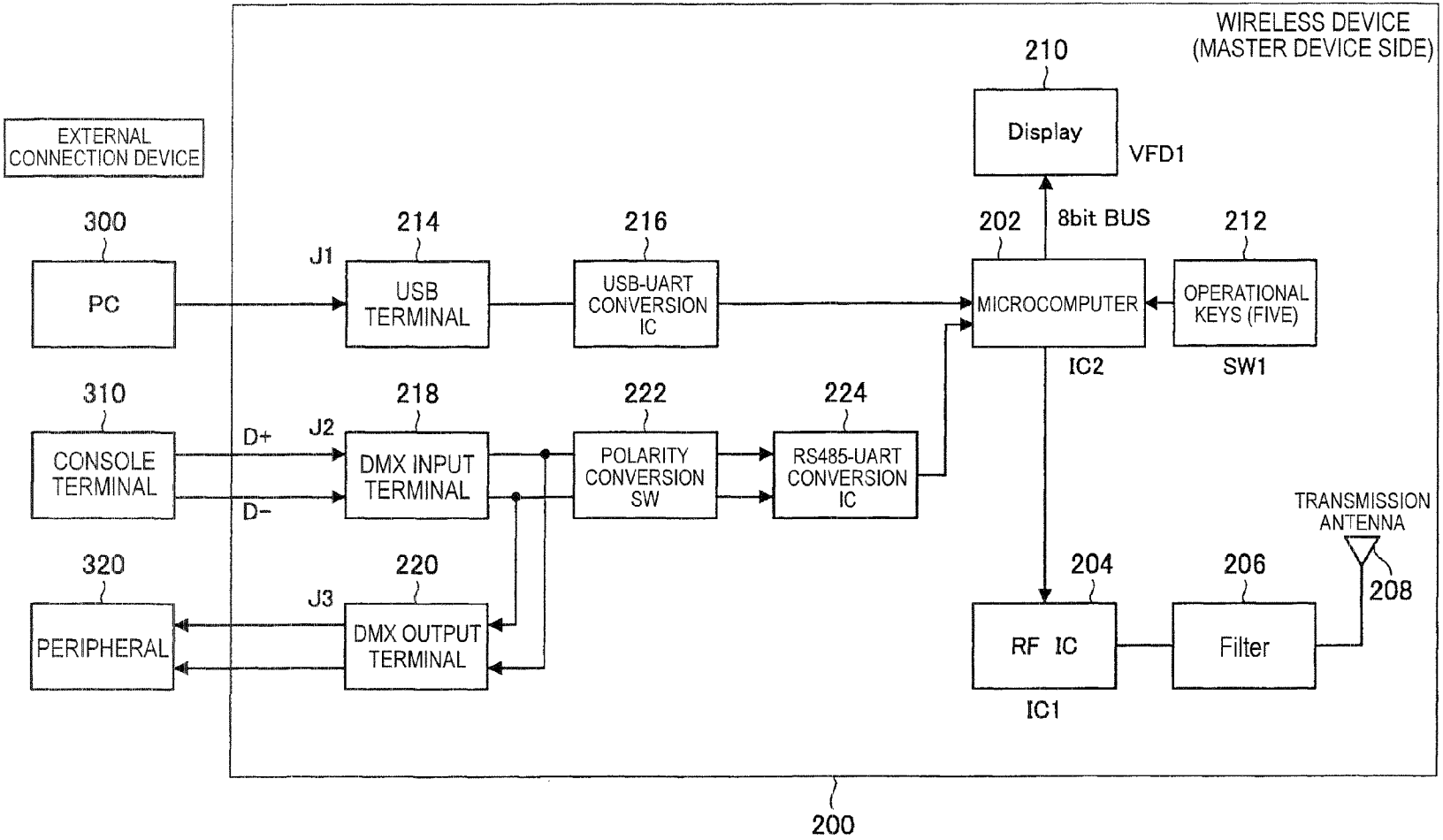
FIG. 3 is a schematic diagram illustrating the configuration of a master device.

FIG. 3 is a schematic diagram illustrating the configuration of the master device 200. As shown in FIG. 3, the master device 200 includes a control unit 202, an RF_IC 204, a filter 206, a transmission antenna 208, a display unit 210, an operational key 212, a USB terminal 214, a conversion IC 216, a DMX input terminal 218, a DMX output terminal 220, a polarity conversion SW 222, and a conversion IC 224.

A personal computer (PC) 300 as an external connection device, a console terminal 310, and a peripheral (spotlight or the like) 320 are connected to the master device 200. The PC 300 inputs initial setting values to the master device 200 through an operation of the user. The initial setting values are, for example, the initial setting values of the blinking frequency, the emission color, the luminance, and the like of the slave device 100. Further, in response to a user's operation, the PC 300 can also transmit light-emitting control information (the emission color, the luminance, and the turn-on and turn-off times) to the master device 200 in real time by an application of the PC 300. The initial setting values are input to the USB terminal 214 of the master device 200, are converted into UART by the conversion IC 216, and are transmitted to the control unit 202. The control unit 202 includes a memory that stores the initial setting values. When power is input, the slave device 100 drives (emits) the 3-color LEDs 112*a*, 112*b*, and 112*c* in accordance with the initial setting values.

The console terminal 310 inputs driving characteristic values used to drive the slave device 100 to the master device 200 through an operation of the user. The driving characteristic values are, for example, the values of the blinking frequency, the emission color, the luminance, and the like of the slave device 100 and are the values changed from the initial setting values. Further, the driving characteristic values include characteristic values used to drive the peripheral 320 connected to the master device 200. The driving characteristic values are input to the DMX input terminal 218 of the master device 200, are transmitted from the polarity conversion SW 222 to the conversion IC 224, are converted into serial data by the conversion IC 224, and are transmitted to the control unit 202.

The driving characteristic values are transmitted to the DMX output terminal 220 and are transmitted to the peripheral 320 which is an external connection device. For example, when the peripheral 320 is a spotlight used in a concert hall, the angle of the spotlight is changed based on the driving characteristic values.

The driving characteristic values are transmitted from the console terminal 310 to the DMX input terminal 218 by a DMX protocol (DMX 512-A) widely used in an acoustic field and are also transmitted from the DMX output terminal 220 to the peripheral 320. The driving characteristic values transmitted by the DMX protocol are converted into serial data by the UART conversion IC 224 and are transmitted to the control unit 202.

[4. Transmission Data in Master Device]

Figure 4:
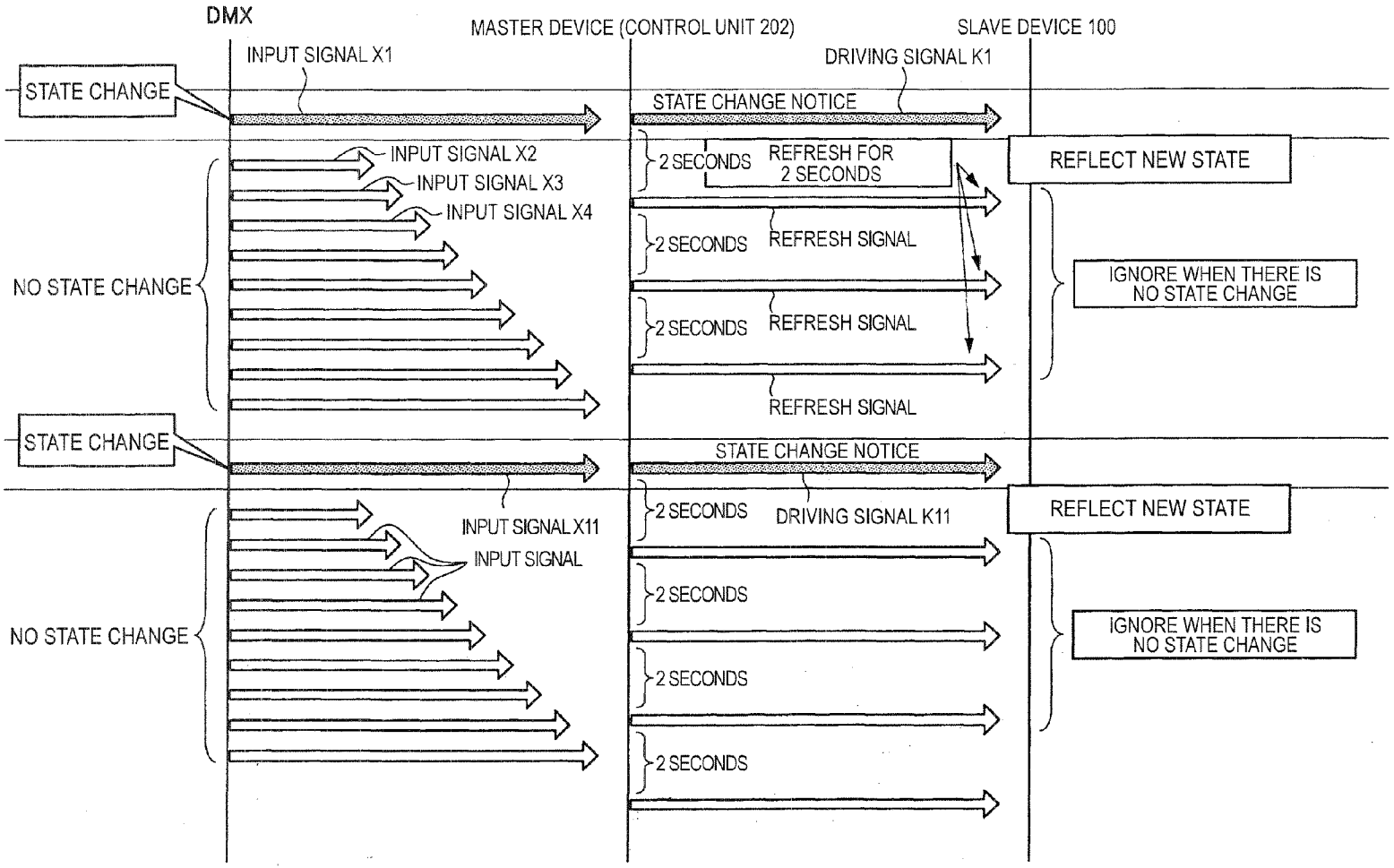
FIG. 4 is a schematic diagram illustrating transmission data in the master device.

FIG. 4 is a schematic diagram illustrating transmission data in the master device 200. An input signal including the driving characteristic values is input at a predetermined period from the console terminal 310 to the DMX input terminal 218, is converted by the conversion IC 224, and is transmitted to the control unit 202. When the driving characteristic values included in the input signal are changed from the previous state, the control unit 202 transmits a driving signal to the slave device 100 based on this change.

Specifically, when the driving characteristic values in an input signal X1 are changed from the previous state, the control unit 202 transmits a driving signal K1 to the slave device 100. The driving signal K1 includes information regarding a state change. Thereafter, input signals X2, X3, . . . are input to the control unit 108. However, since the state change in the driving characteristic values does not occur, the control unit 202 does not transmit a driving signal for noticing the state change. On the other hand, even when the state change does not occur, the control unit 202 transmits a refresh signal to the slave device 100 at intervals of 2 seconds. When the state change does not occur, the slave device 100 ignores the refresh signal.

Next, when an input signal X11 including the state change in the driving characteristic values is input, the control unit 202 transmits a driving signal K11 including the state change to the slave device 100 based on the input signal X11. The slave device 100 changes the luminance of light, a color, a blinking frequency, and the like based on the driving signal K11.

With reference to FIG. 3, the control unit 202 receives an input signal from the conversion IC 224. When the control unit 202 receives the input signals X1 and X11 including the state change in the driving characteristic values, the control unit 202 instructs the RF_IC 204 to transmit the driving signals K1 and K11 including the state change in the driving characteristic values. Based on this instruction, the RF_IC 204 transmits the driving signals K1 and K11 to the slave device 100. The driving signals K1 and K11 are subjected to a process of removing an unnecessary component by the filter 206, and then are transmitted from the transmission antenna 208.

The control unit 202 does not transmit the driving signals when the received input signal does not include the state change in the driving characteristic values. On the other hand, when the received input signal does not include the state change in the driving characteristic values, the control unit 202 instructs the RF_IC 204 to transmit a refresh signal, for example, at intervals of 2 seconds. The intervals of the instruction to transmit the refresh signal are not limited to 2 seconds. Based on this instruction, the RF_IC 204 transmits the refresh signal to the slave device 100. The refresh signal is subjected to the process of removing an unnecessary component by the filter 206, and then is transmitted from the transmission antenna 208.

[5. Transmission Packet from Master Device]

Figure 5:
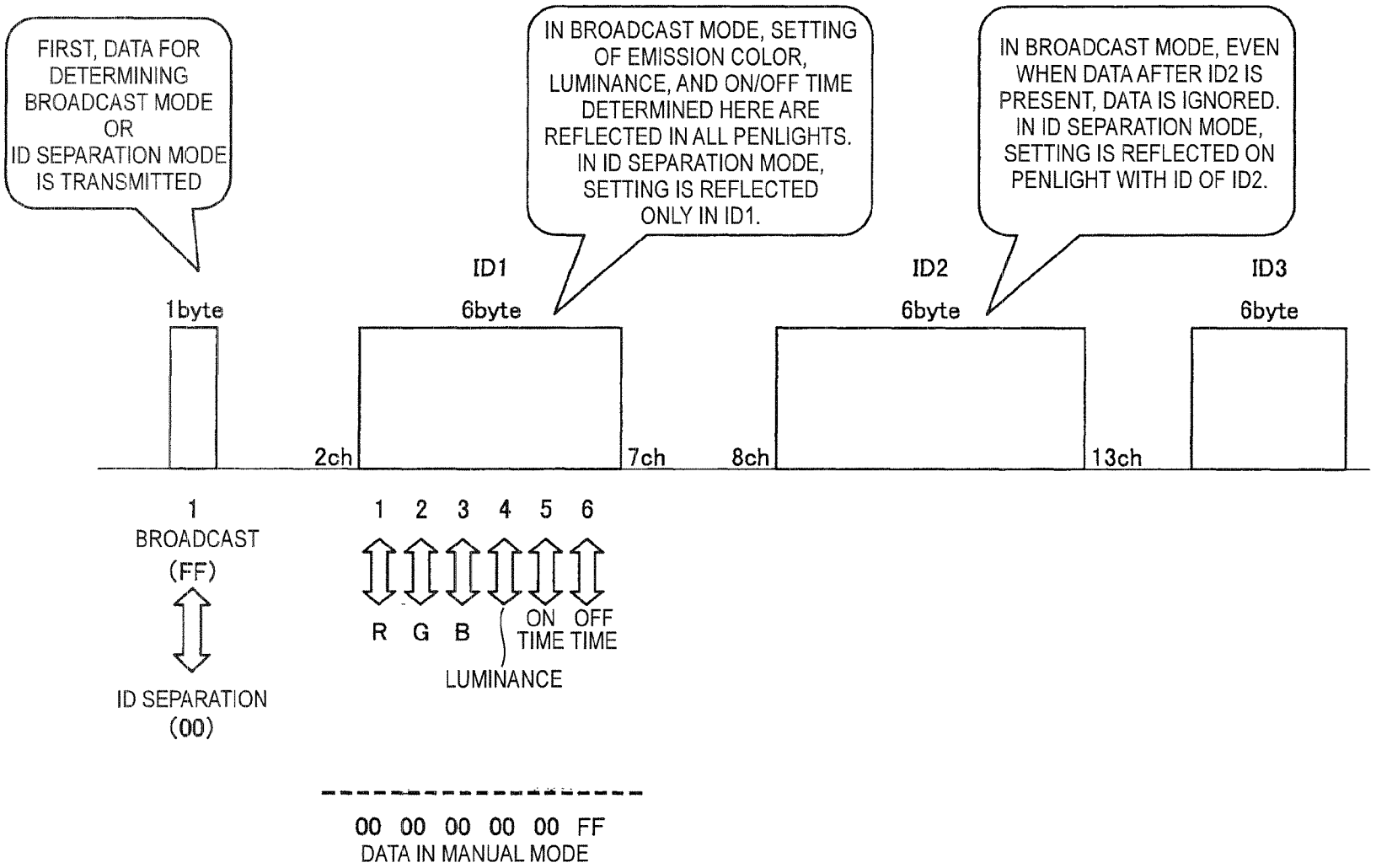
FIG. 5 is a schematic diagram illustrating a driving signal (transmission packet) transmitted from the master device to the slave device.

FIG. 5 is a schematic diagram illustrating a driving signal (transmission packet) transmitted from the master device 200 to the slave device 100. In this embodiment, it is possible to control turn-on and turn-off of the slave device 100 in a broadcast mode, an ID separation mode, and a manual mode. Both of the broadcast mode and the ID separation mode are modes in which the master device 200 transmits a driving signal and controls the slave device 100.

When the slave device 100 is a penlight used in a concert hall, all of the slave devices 100 in the concert hall are controlled with the same emission color, luminance, and turn-on/off time in the broadcast mode. On the other hand, in the ID separation mode, the control is performed so that the emission color, luminance, turn-on/off time is different for each ID allocated to each slave device 100.

The manual mode is a mode in which the slave device 100 is controlled through a manual operation of a user carrying the slave device 100. In the manual mode, the user can set the emission color, the luminance, and the turn-on/off time of a blinking process by operating a button of the switch 114 of the slave device 100.

A case of the broadcast mode and the ID separation mode will be described with reference to FIG. 5. First, a signal (1 byte) for determining the broadcast mode or the ID separation mode is transmitted. The value of the signal is set to "FF" in the case of the broadcast mode and is set to "00" in the case of the ID separation mode.

Next, a 6-type transmission packet is transmitted to the slave device 100. In the transmission packet, an RGB ratio (3 bytes), luminance (1 byte), an ON time (1 byte), and an OFF time (1 byte) are defined. In the broadcast mode, the setting of the emission color, luminance, and ON/OFF time determined here are reflected in all of the slave devices 100. Each slave device 100 controls turn-on and turn-off states in accordance with the emission color, the luminance, and the ON/OFF time determined by the transmission packet. On the other hand, in the ID separation mode, the setting of the emission color, luminance, and ON/OFF time is reflected only in the slave device 100 with ID1.

Next, a transmission packet after 1D2 is transmitted to the slave device 100. In the broadcast mode, even when a signal after ID2 is transmitted, the signal is ignored by the slave device 100. In the ID separation mode, the slave device 100 with an ID of ID2 controls the turn-on and turn-off states in accordance with the emission color, the luminance, and the ON/OFF time determined by the transmission packet.

Thereafter, as described in FIG. 4, when the state change occurs, a driving signal (transmission packet) including the state change is transmitted to the slave device 100. As described above, the master device 200 transmits the transmission packet to the slave device 100 when the state change occurs in the input signal received from the console terminal 300. Thus, the turn-on and turn-off states of the slave device 100 can be changed in real time through an operation of the console terminal 300.

When the state change does not occur, a refresh signal is transmitted from the master device 200 to the slave device 100. The slave device 100 does not change the turn-on and turn-off states and continues the turn-on and turn-off states up to the present when the slave device 100 receives the refresh signal.

Here, with reference to FIG. 2, the transmission packet is received by the reception antenna 102 of the slave device 100, is subjected to the process of removing an unnecessary component by the filter 104, and is transmitted to the RF_IC 106. The RF_IC 106 extracts the emission color (RGB ratio), the luminance, and the ON/OFF time included in the transmission packet and transmits the emission color, the luminance, and the ON/OFF time to the control unit 108. The control unit 108 instructs the LED driver 110 to drive the 3-color LEDs 112*a*, 112*b*, and 112*c* based on information regarding the emission color (RGB ratio), the luminance, and the turn-on/off time transmitted from the RF_IC 106. The LED driver 110 causes the 3-color LEDs 112*a*, 112*b*, and 112*c* to emit light based on the information regarding the emission color (RGB ratio), the luminance, and the turn-on/off time.

Figure 6:
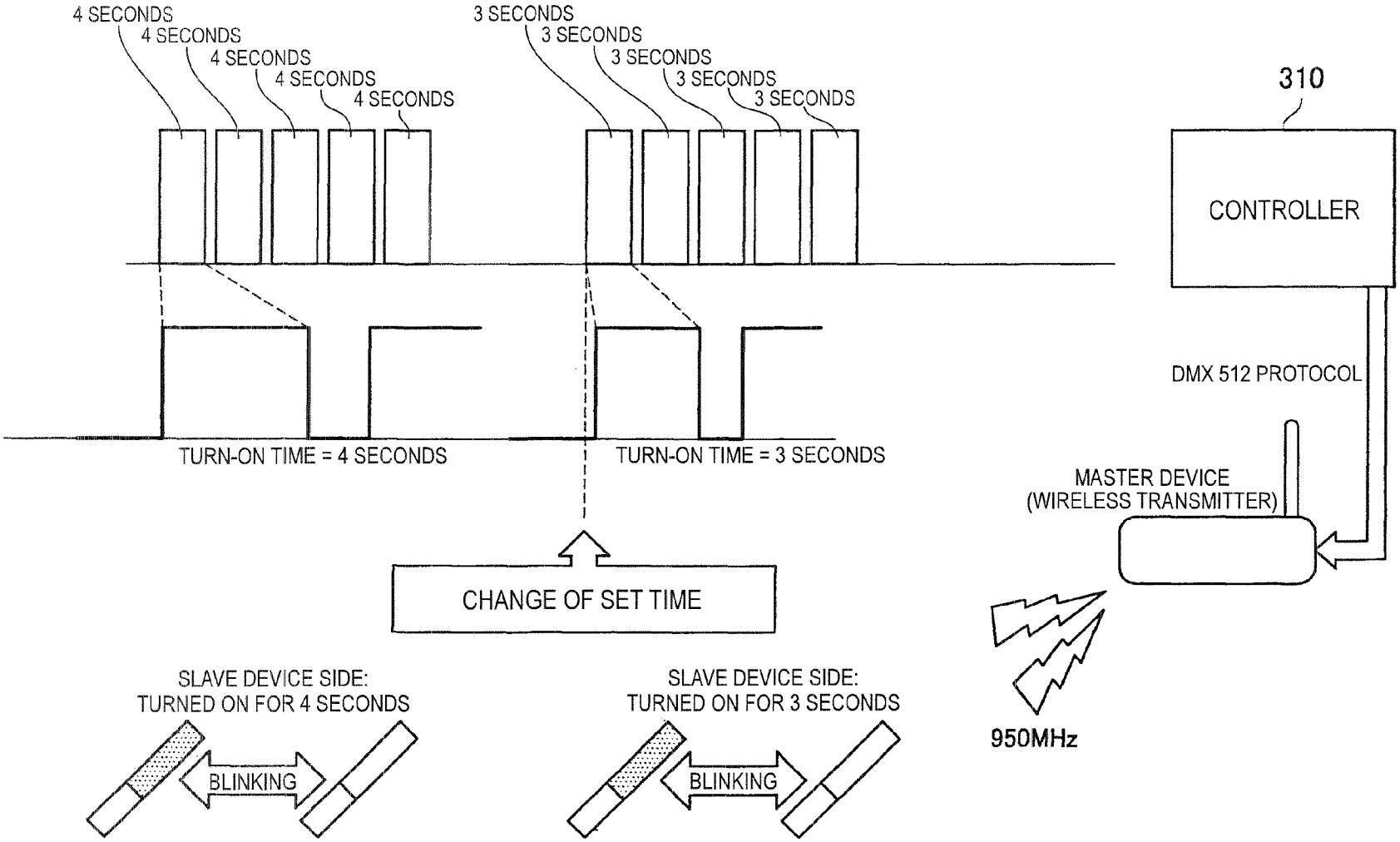
FIG. 6 is a schematic diagram illustrating a case in which a state change occurs.

FIG. 6 is a diagram illustrating an example when the state change occurs. In the example shown in FIG. 6, the console terminal 310 transmits information indicating that the turn-on time is 4 seconds to the master device 200. This information is transmitted to the master device 200, for example, at 950 [MHz] by the DMX 512 protocol. Further, the transmission frequency of the information is not limited to 950 [MHz]. The master device 200 frequently checks the data transmitted by the console terminal 310. When there is a difference between the setting value of the blinking interval time of the slave device 100 and the previously received value, the master device 200 wirelessly transmits the changed setting value to the slave device 100. In the example shown in FIG. 6, the information regarding the turn-on time of 4 seconds is changed to information regarding the turn-on time of 3 seconds from a given time point. In this case, the control unit 202 of the master device 200 detects the change in the turn-on and turn-off time, transmits the transmission packet to the slave device 100, and changes the turn-on and turn-off time. Further, when the information from the console terminal 310 is not changed, the setting value of the turn-on and turn-off time is not transmitted again and the refresh signal is periodically transmitted.

[6. Control of Turn-on and Turn-off Time]

Figure 7:
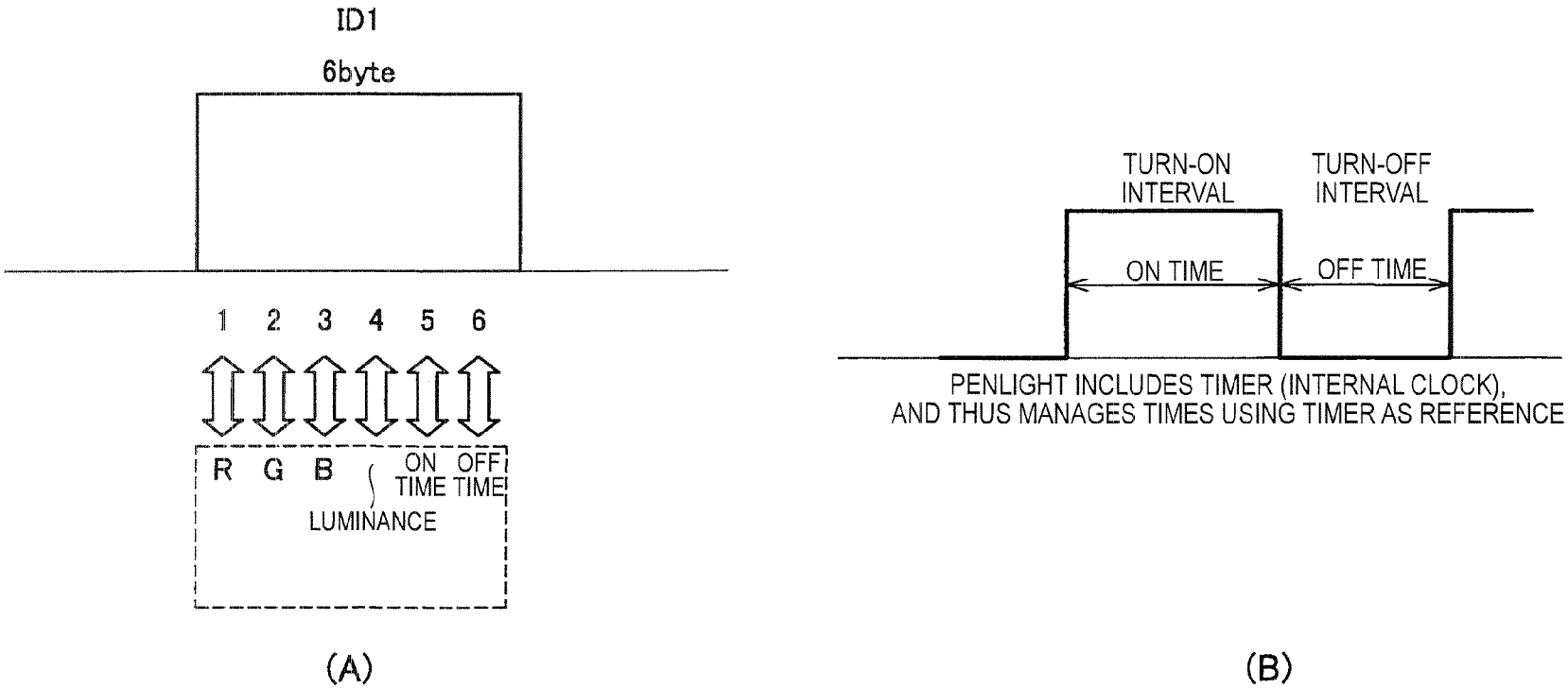
FIGS. 7(A) and 7(B) are schematic diagrams illustrating control of a blinking time of a slave device.

FIGS. 7(A) and 7(B) are schematic diagrams illustrating control of a blinking time of the slave device 100. As shown in FIG. 7(A), a packet transmitted to the slave device 100 includes information regarding the ON time and the OFF time. The slave device 100 performs a blinking (turn-on and turn-off) process based on the received information regarding the ON time and the OFF time.

As shown in FIG. 7(B), the slave device 100 receiving the packet performs the blinking process using the ON time as a turn-on interval and the OFF time as a turn-off interval. At this time, the control unit 108 of the slave device 100 includes a timer (internal clock), and thus manages the turn-on interval and the turn-off interval using the timer as a reference.

[7. Two Modes in Which Turn-on and Turn-off Time Is Controlled]

In this embodiment, blinking control is performed in one of a low-speed blinking mode and a high-speed blinking mode in accordance with the values of the ON time and the OFF time.

Figure 8:
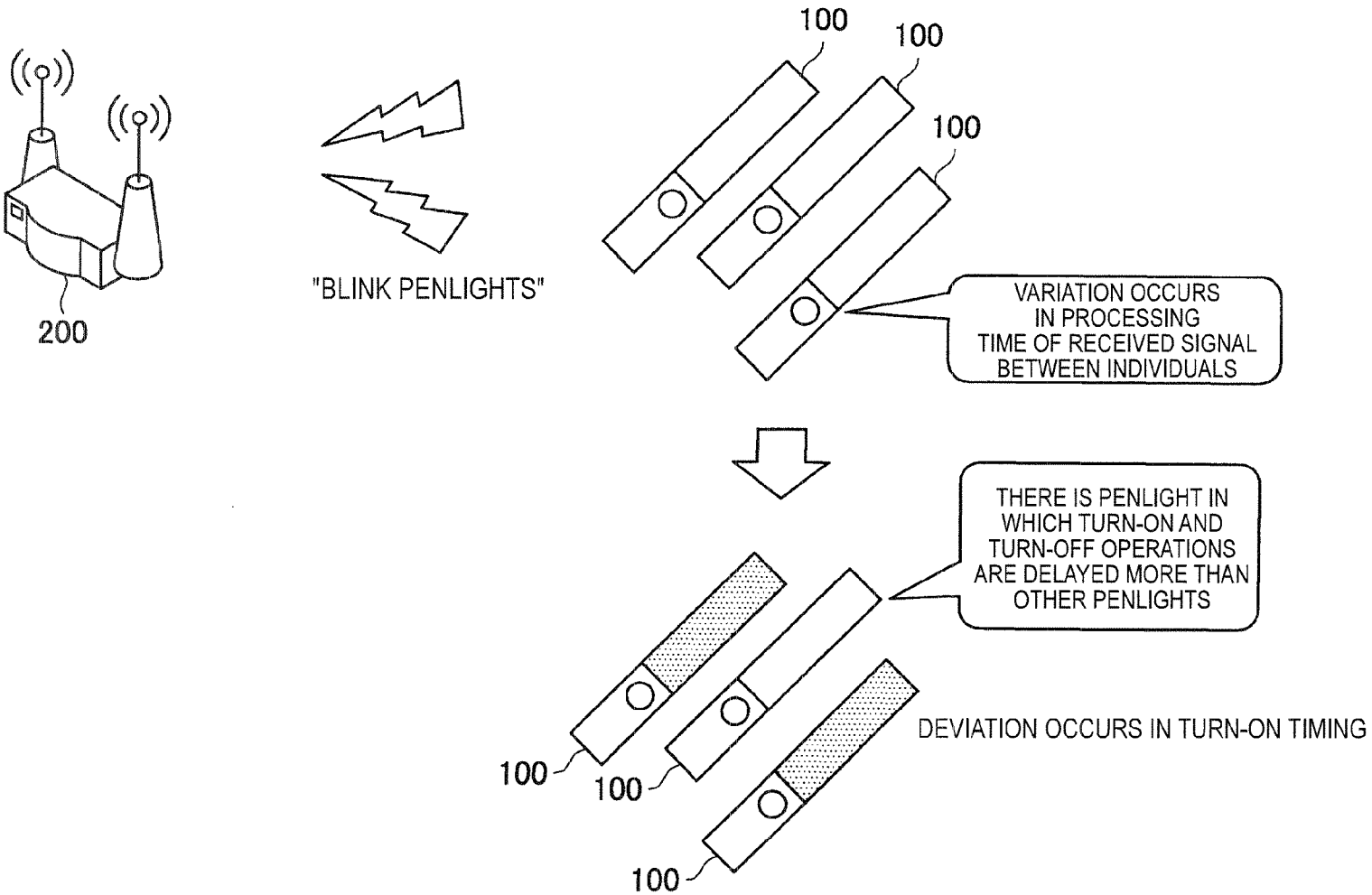
FIG. 8 is a schematic diagram illustrating an example in which a variation occurs in a turn-on timing between a plurality of individual slave devices.

As described above, the slave device 100 performs the blinking process based on the ON time and the OFF time received from the master device 200. At this time, in the plurality of slave device 100, a deviation in the oscillation frequency of the clock of the control unit (microcomputer) 108 may occur for each slave device 100. Therefore, when the blinking timing is controlled by the clocks of all the slave devices 100, a variation occurs in a processing time of a received signal between the plurality of individual slave devices 100. Therefore, there is a probability that the turn-on and turn-off processes of some of the slave devices 100 are performed later than those of the other slave devices 100. In particular, when an oscillator inside an IC is used as the clock of the control unit 108 rather than a simple oscillator to reduce a manufacturing cost, a deviation of a small percentage may occur in the oscillation frequency. Further, a variation occurs in the processing time of the received signal between the individual slave devices 100. As a result, as shown in FIG. 8, the variation occurs in the turn-on and turn-off timings between the plurality of individual slave devices 100. Therefore, when thousands of penlights are simultaneously turned on and turned off, the penlights may seem to be turned on and turned off separately. When the master device designates the turn-on time and turn-off time and performs a command, and then the blinking process is entrusted to the slave devices 100, the first blinking process is simultaneously performed. However, since the individual differences accumulate over time, the turn-on and turn-off timings gradually deviate. In particular, in a concert or the like in which several thousands of penlights or tens of thousands of penlights simultaneously blink for a long time, the deviation is assumed to be considerably noticed.

Figure 9:
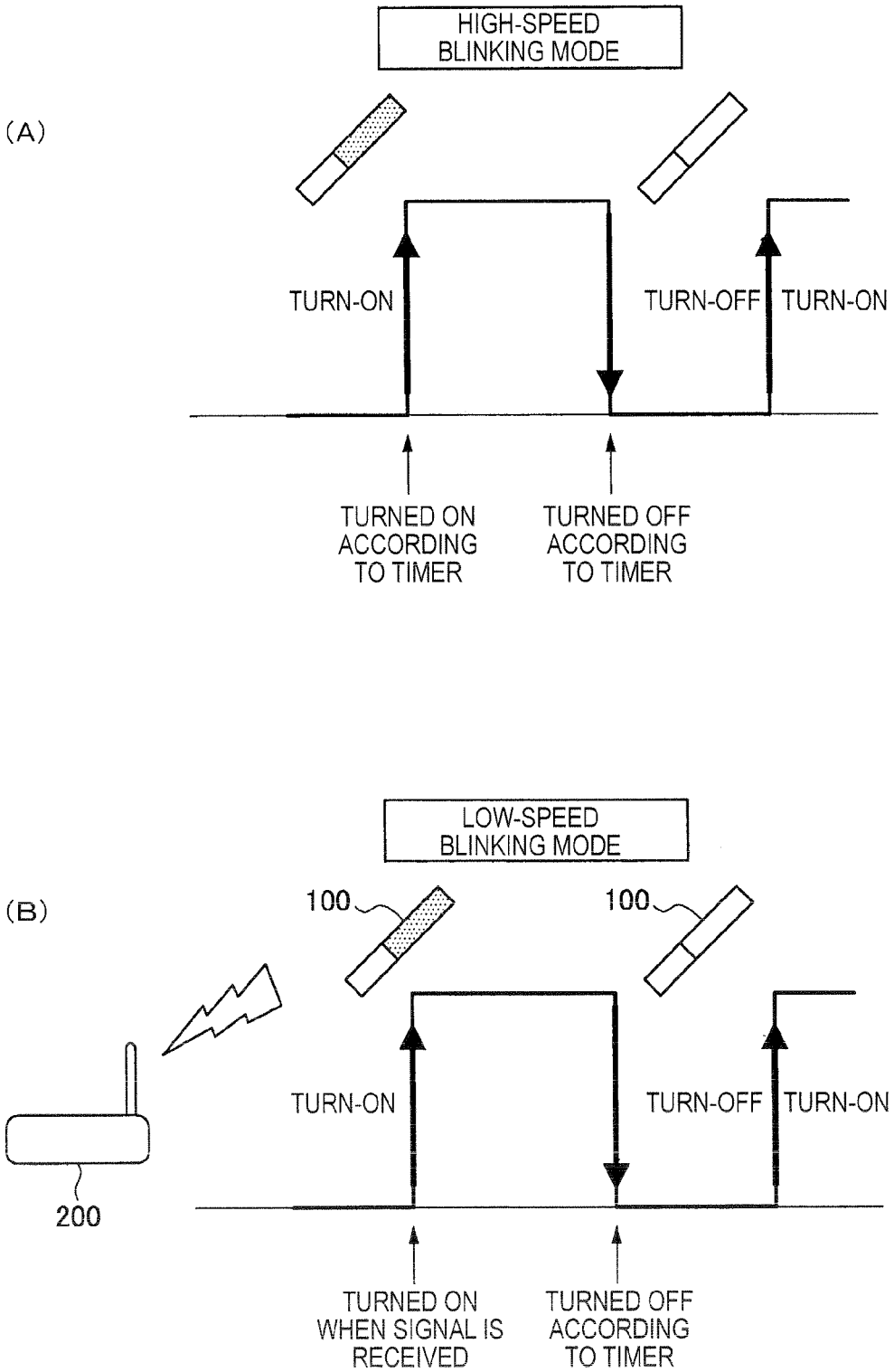
FIGS. 9(A) and 9(B) are schematic diagrams illustrating a case in which another control is performed by blinking (low-speed blinking mode) of a frequency at which a deviation in light emission is easily noticed and blinking (high-speed blinking mode) of a frequency at which the deviation in the light emission is hardly noticed.

For this reason, in this embodiment, as shown in FIGS. 9(A) and 9(B), another control is configured to be performed by blinking (low-speed blinking mode) of a frequency at which a deviation in light emission is easily noticed and blinking (high-speed blinking mode) of a frequency at which the deviation in light emission is hardly noticed.

In the low-speed blinking mode, as shown in FIG. 9(B), the master device 200 transmits a signal for a turn-on and turn-off instruction at intervals of the ON time+the OFF time and the slave device 100 performs the turn-on upon receiving the signal. Therefore, the turn-on timing of the slave device 100 is controlled by the master device 200. The slave device 100 measures the time after the turn-on by the timer of the control unit 108 and turns off when the ON time has elapsed. Therefore, the turn-off timing is controlled by the slave device 100.

Figure 10:
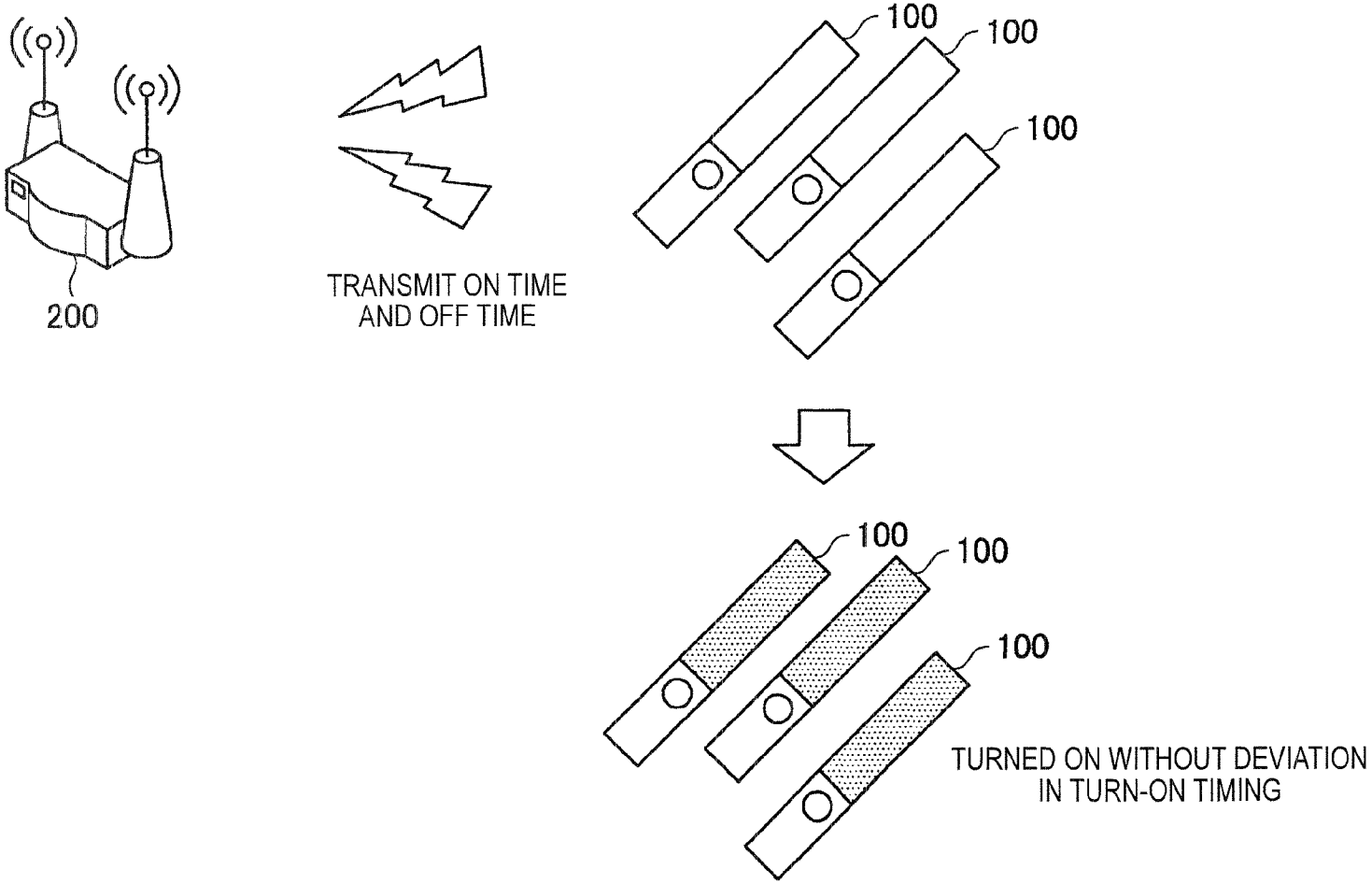
FIG. 10 is a schematic diagram illustrating a case in which the plurality of slave devices are simultaneously turned on and turned off.

Thus, in the low-speed blinking mode, the turn-on timing is controlled by the master device 200 and the turn-off timing is controlled by the timer of the slave device 100. In the slave device 100, the control unit 108 performs the turn-on at the reception timing of a packet and turns off when the ON time has elapsed according to the timer of the slave device 100. Thus, by performing the turn-on process of the blinking process every time a packet is received wirelessly, it is possible to prevent a deviation in the turn-on timing caused due to the individual difference of the timer of the slave device 100. In other words, even when a deviation occurs in the turn-on timing, the maximum deviation duration is the first turn-off time and the deviation duration does not accumulate over time. Thus, the turn-on timings of the plurality of slave devices 100 can coincide with high accuracy. Further, by causing the turn-on timings of the plurality of slave devices 100 to coincide with each other, the turn-off timings controlled by the timers of the respective slave devices 100 can coincide. Accordingly, in the low-speed blinking mode in which the variation in the turn-on timing is easily noticed, the turn-on and turn-off timings of all the slave devices 100 can coincide when the turn-on is controlled based on the signal from the master device 200. Thus, as shown in FIG. 10, it is possible to simultaneously turn the plurality of slave devices 100 on and off.

On the other hand, in the high-speed blinking mode, as shown in FIG. 9(A), the control unit 108 of the slave device 100 controls both of the turn-on timing and the turn-off timing by the timer of the control unit 108. Thus, since it is not necessary to transmit the signal from the master device 200 at every turn-on timing, it is possible to reduce traffic of a wireless communication channel. Further, in the high-speed blinking mode, the variation in the turn-on and turn-off timing in the plurality of slave devices 100 is not recognizable. Accordingly, it is possible to prevent a user from feeling a sense of discomfort.

For example, the determination of the low-speed blinking mode or the high-speed blinking mode is performed by comparison with a threshold value as follows.

ON time+OFF time≥Threshold Value→Low-speed Blinking Mode

ON time+OFF time<Threshold Value→High-speed Blinking Mode

For example about 1 second or 2 seconds can be set as the threshold value, but the embodiment of the present disclosure is not limited thereto.

[8. Processing Flow of Embodiment]

Figure 11:
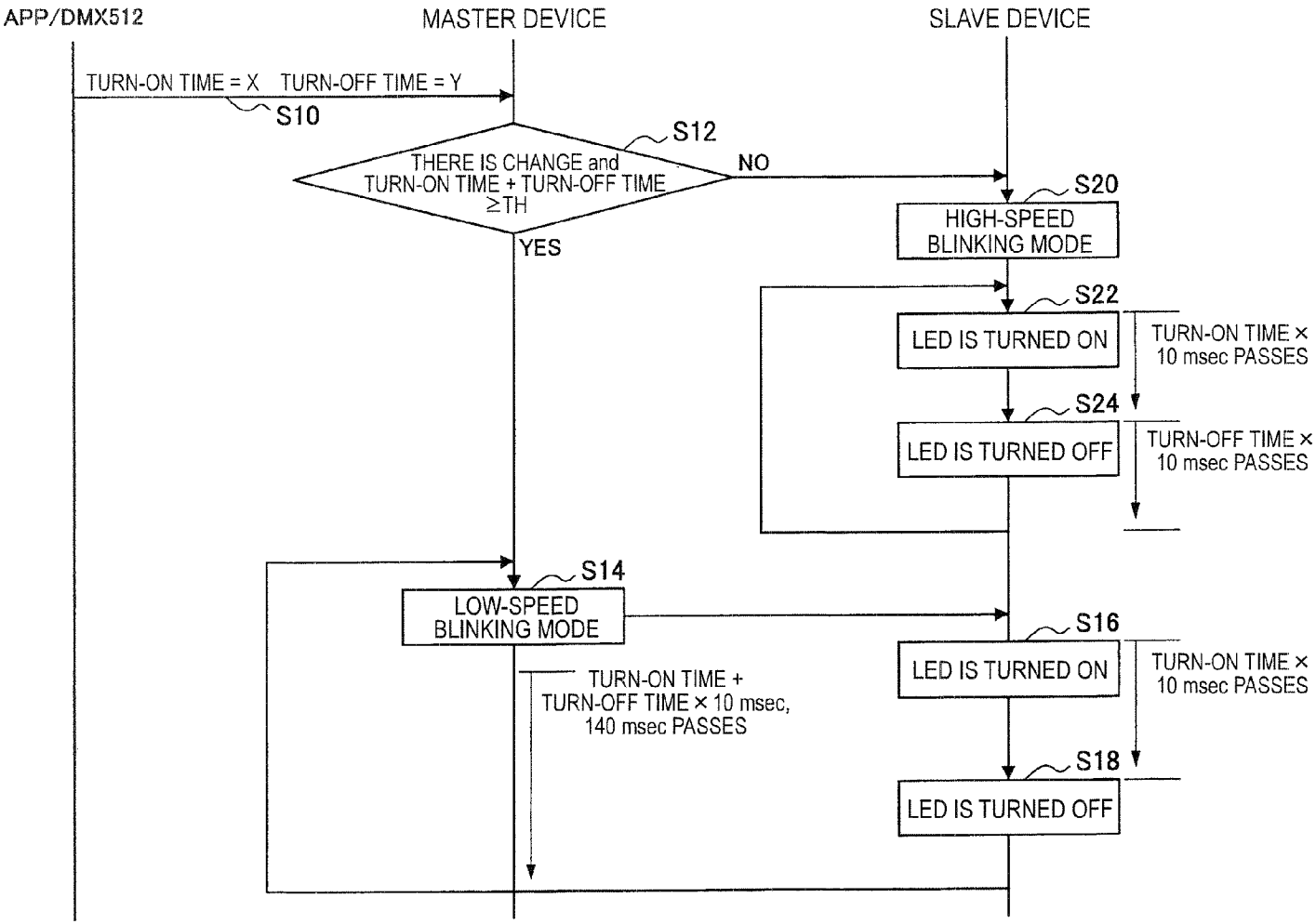
FIG. 11 is a flowchart illustrating a process according to the embodiment.

FIG. 11 is a flowchart illustrating a process according to this embodiment. In FIG. 11, the console terminal (APP/DMX 512) 310, the master device 200, and the slave device 100 are sequentially shown. First, in step S10, a turn-on time X and a turn-off time Y are input from the console terminal 310 to the control unit 202 of the master device 200. In step S12, the input signal is changed with respect to the previous signal, and thus it is determined whether the turn-on time+the turn-off time≥TH. Here, TH indicates a predetermined threshold value.

In step S12, when the input signal is changed with respect to the previous signal and the turn-on time+the turn-off time≥TH, the process proceeds to step S14. In step S14, the mode transitions to the low-speed blinking mode. Next, in step S16, the slave device 100 turns on the LEDs based on the signal transmitted from the master device 200. Next, in step S18, when the turn-on time×10 [ms] passes, the LEDs are turned off. After step S18, the process returns to step S14. Thereafter, in step S16, the slave device 100 turns on the LEDs again based on the signal transmitted from the master device 200 and repeats the subsequent process.

Conversely, when the input signal is not changed with respect to the previous signal in step S12 or the turn-on time+the turn-off time<TH, the process proceeds to step S20. In step S20, the mode transitions to the high-speed mode. In step S22, the LEDs are turned on based on the timer of the slave device 100. Then, when the turn-on time×10 [ms] passes, the LEDs are turned off in step S24. Thereafter, when the turn-off time×10 [ms] passes, the process returns to step S22 and the LEDs are turned on.

In the process of FIG. 11, the LEDs are turned on based on the signal from the master device 200 in the low-speed blinking mode (step S16) and the LEDs are turned off by the timer of the slave timer 100 (step S18). In the high-speed blinking mode, the LEDs blink according to the timer of the slave device 100 (steps S22 and S24). Accordingly, in the low-speed blinking mode, the blinking timings of the plurality of slave devices 100 can coincide. In the high-speed blinking mode, it is possible to minimize communication between the master device 200 and the slave devices 100.

[9. Control by Clock Inside Slave Device]

Next, control based on an internal clock of the slave device 100 will be described. The slave device 100 includes an internal clock, and thus can control the turn-on and turn-off at predetermined times based on information regarding the turn-on and turn-off times received from the master device 200. In this case, the master device 200 transmits information regarding the ON time (hour and minute) and the OFF time (hour and minute) to the slave devices 100 in advance. For example, at a New Year's concert or the like, the slave devices 100 are desired to turn on simultaneously with the New Year, the master device 200 transmits information regarding the ON time and OFF time including clock information of 23:59 on Dec. 31, 2011 as the ON time to the slave devices 100 in advance. When the slave devices 100 detect the internal timer (internal clock) after receiving the ON time. At the appointed time, the slave devices 100 turn on at 23:59 on Dec. 31, 2011 by developing the information regarding the ON time and OFF time and control the turn-on and turn-off. Thus, it is possible to turn on (blink) or turn off several thousands of slave devices 100 or several tens of thousands of slave devices 100 together at the appointed time.

[10. Control in Accordance with Audio Level and Frequency of Song]

Figure 12:
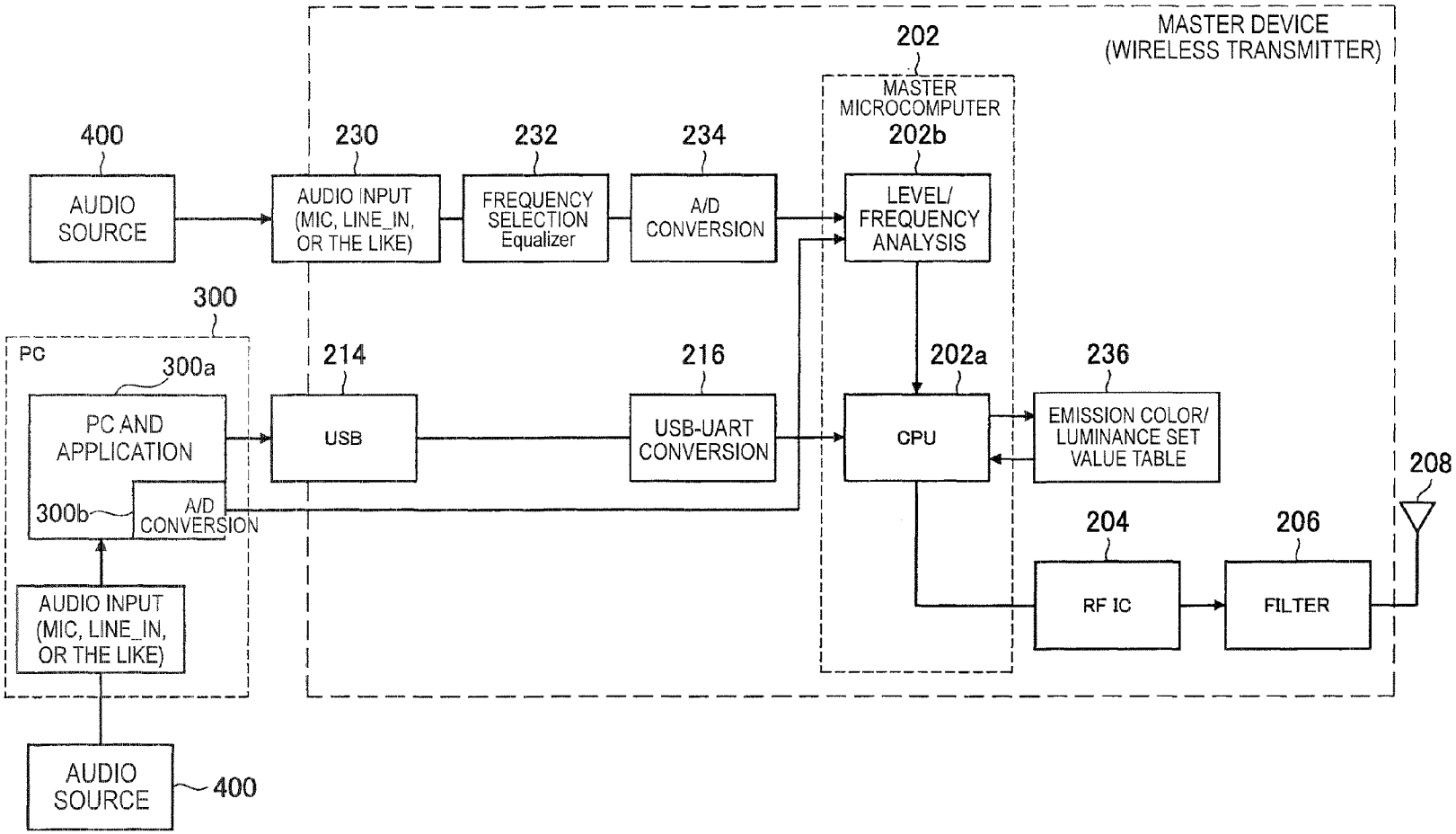
FIG. 12 is a schematic diagram illustrating an example of control of an emission color, luminance, and blinking of the slave device in accordance with a song.

Next, a case in which control of an emission color, luminance, and blinking of the slave device 100 is performed in accordance with an audio level and a frequency of a song when the slave devices 100 and the master device 200 are used in a concert hall or the like will be described. FIG. 12 is a schematic diagram illustrating an example of the control of the emission color, luminance, and blinking of the slave device 100 in accordance with a song.

As shown in FIG. 12, the master device 200 includes an audio input unit 230, a frequency selection unit 232, an A/D conversion unit 234, and an emission color/luminance set value table 236 in addition to the configuration shown in FIG. 3. Here, the following three patterns will be exemplified as methods of controlling the slave device 100 in accordance with a song.

Pattern 1

First, an audio signal is input from an audio source 400 to the audio input unit 230 of the master device 200. The audio signal is transmitted from the audio input unit 230 to the frequency selection unit 232. The frequency selection unit 232 selects a frequency band based on the audio signal and transmits the selected frequency band to the A/D conversion unit 234. The A/D conversion unit 234 performs A/D conversion on the input signal and transmits the converted signal to the control unit 202. The control unit 202 includes a CPU 202*a* and a level/frequency analysis unit 202*b*. The level/frequency analysis unit 202*b* selects an audio level or a frequency for the signal input from the A/D conversion unit 234. The CPU 202*a* reads the emission color and the luminance corresponding to the obtained value from the emission color/luminance set value table 236.

For example, in the emission color/luminance set value table 236, a correlation between the luminance and the audio level (volume) is defined. When the audio level is small, the luminance of the slave device 100 is darkened. When the audio level is large, the luminance of the slave device 100 is brightened. Further, in the emission color/luminance set value table 236, a correlation between a frequency component and the emission light is defined. When the frequency is low, a blue-based emission color is set. When the frequency is high, a red-based emission color is set. The control unit 202 wirelessly transmits the value read from the emission color/luminance set value table 236 to the slave device 100.

Pattern 2

In Pattern 2, an audio signal is input from the audio source 400 to the PC 300. The audio level and the frequency of the audio signal input from the audio source 400 to the PC 300 are analyzed by an application 300*a* of the PC 300. The analysis result is acquired by the control unit 202 of the master device 200 via the USB terminal 214. The control unit 202 (CPU 202*a*) reads an emission color/luminance corresponding to the acquired value from the emission color/luminance set value table 236 and wirelessly transmits the read value to the slave device 100.

Pattern 3

An audio signal input from the audio source 400 is subjected to analysis of the frequency selection in the application 300*a* of the PC 300. The analysis result is subjected to the A/D conversion by the A/D conversion unit 300*b* of the PC 300 and is input to the control unit 202 of the master device 200. The control unit 202 reads the emission color/luminance corresponding to the acquired value from the emission color/luminance set value table 236. Then, the control unit 202 wirelessly transmits the read value to the slave device 100.

In such a configuration, the blinking of the emission color and luminance of the slave device 100 can be controlled in accordance with the audio level and the frequency of a song, and thus a sense of unity between audience members and artists in a concert hall can be enhanced.

[11. Function of Proceeding to Manual Mode]

As described above, the slave device 100 can be also controlled in the manual mode. The manual mode is a mode in which any emission color, blinking frequency, luminance, and the like desired by the user can be changed through an operation on the switch 114 of the slave device 100. The manual mode includes a manual mode under DMX control and a manual mode (under the DMX control and control through a switch operation of the slave device 100 by the user) as a user mode. The manual mode is set as the user mode in the following situation in which a wireless signal may not be received.

In this embodiment, when the slave device 100 does not receives a refresh signal from the master device 200 for a given time, the slave device 100 determines that the current state is not a communicable state, and thus causes the mode to proceed to the manual mode. With the manual mode as the user mode in the situation in which the DMX signal is not transmitted, carrier sensing is not performed.

When the slave device 100 is caused to emit light based on a signal from the master device 200, the slave device 100 does not emit in a situation in which wireless control is not enabled for any reason. When the slave devices 100 are used at an event such as a concert, users may not enjoy the event. In order to avoid such a situation, the mode transitions to the manual mode when the wireless communication is disabled. Thus, the users can arbitrarily change the emission color or the like by manually operating the slave device 100, and thus continue to enjoy the event.

Even while the manual mode operates, the slave device 100 repeats a carrier sensing process. Thus, the slave device 100 can be controlled by the master device 200 promptly at any time at which the communication is reactivated.

Figure 13:
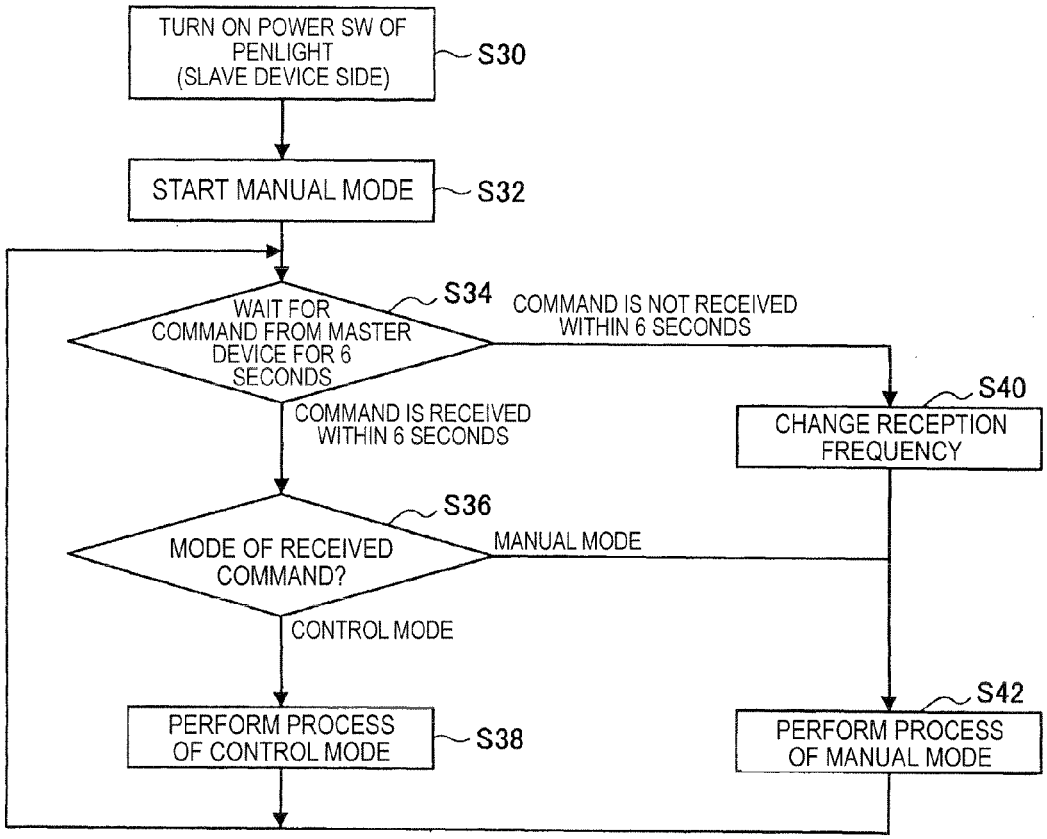
FIG. 13 is a flowchart illustrating a process of changing a mode to a manual mode.

FIG. 13 is a flowchart illustrating a process of changing the mode to the manual mode. In this process, as described above, on the assumption that signals may not wirelessly be received for any reason while audience members are waving penlights at a concert or the like, the audience members can arbitrarily change the emission colors or the blinking by operating buttons of the penlights.

First, in step S30, the power SW of the slave device (penlight) 100 is turned on. Next, in step S32, the manual mode starts. Next, in step S34, it is determined for 6 seconds whether a command is received from the master device 200.

When the command is received from the master device 200 within 6 seconds in step S34, the process proceeds to step S36. In step S36, the mode of the received command is detected. When the mode is the control mode, the process proceeds to step S38. In step S38, the process in the control mode is performed. In the control mode, each LED is controlled in response to an instruction from the master device 200.

When the command is not received from the master device 200 even after 6 seconds in step S34, the process proceeds to step S40. In step S40, the reception frequency is changed. Thereafter, the process proceeds to step S42 to switch to the process of the manual mode. Thus, the emission color of the LED can be changed through a user's operation.

After step S38 and step S42, the process returns to step S34. When the command was not previously received within 6 seconds, the command may be received within another 6 seconds after the process returns to step S34 from step S42 in some cases due to the fact that the reception frequency is changed in step S40. When the command is received within 6 seconds, the process proceeds to step S36. When the received command indicates the control mode, the turn-on and turn-off of the control mode is performed in step S38.

In the process of FIG. 13, as described above, when the command from the master device 200 is paused for, for example, 6 seconds or more during the wireless control mode, the mode switches to the manual mode in the slave device 100. The time is not limited to 6 seconds. When the wireless signal is reactivated, the manual mode is cancelled and the mode can return to the mode of the LED turn-on and turn-off process under the original wireless control.

When a command indicating that the mode switches to the manual mode is transmitted during the mode of the wireless LED turn-on and turn-off process, the mode switches to the manual mode. Further, when a command indicating that the mode switches to the control mode is transmitted during the manual mode, the mode transitions to the control mode.

In the embodiment described above, the mode can switch to the manual mode when a signal is not transmitted from the master device 200 for any reason. Accordingly, even when information is not transmitted from the master device 200, the user can arbitrarily change the emission color and the like by operating the slave device 100.

Next, a change in luminance in the slave device 100 will be described. The control unit 108 of the slave device 100 according to this embodiment can adjust the luminance in a step form (128 steps) of 0% to 100%, and thus can smoothly express the change in luminance of light. The change in luminance is performed based on luminance information included in the transmission packet shown in FIG. 5.

Thus, by changing the luminance in the step form in conformity with music phases, the sense of unity between music and rhythm of light blinking of the penlights of the users can be further realized, and thus the luminance can be controlled as fade-in and fade-out. Thus, for example, in a concert, performance of a song with a slow tempo such as ballad can be effectively realized. Further, by changing a ratio of RGB in accordance with the transmission packet, a given color can be changed to another color. Therefore, a production effect can be realized in a peaceful atmosphere such as at a wedding.

In the LED penlights according to the related art, there are only two modes of turn-on and turn-off. Therefore, when the maximum value of luminance is assumed to be 100, the luminance changes extremely, for example, from 100 to 0 or from 0 to 100. Therefore, the luminance may not fade in and fade out. Accordingly, in the slave device 100 according to this embodiment, the effective performance can be realized by the fade-in and fade-out of the luminance which is not realized in the related art.

The penlight has been described above as an example of the slave device 100, but the slave device 100 may be another device. For example, the slave device 100 may be a microphone (or a microphone stand) that an artist uses in a concert. In this case, by configuring the slave device 100 of penlights and a microphone, the penlights of audience members can be blinked in synchronization with the microphone of the artist, and thus the sense of unity between the artist and the audience members can be improved. Further, when a device such as the microphone or the microphone stand used by the artist includes a light-emitting unit, the sense of unity of the entire venue can be further improved by causing the light-emitting unit to emit light simultaneously with the penlights of the audience members in the same color by the wireless communication.

It should be understood by those skilled in the art that various modifications, combinations, sub-combinations and alterations may occur depending on design requirements and other factors insofar as they are within the scope of the appended claims or the equivalents thereof.

Additionally, the present technology may also be configured as below.

(1) A light-emitting device including:

a wireless communication unit that performs wireless communication with another device;

a light-emitting unit that emits light; and a control unit that performs control by switching between a mode in which the light emission of the light-emitting unit is controlled in accordance with a timing at which a signal is received by the wireless communication unit and a mode in which the light emission of the light-emitting unit is controlled in accordance with an internal timer based on a light emission timing included in a signal received from the other device by the wireless communication unit.

(2) The light-emitting device according to (1), wherein the control unit controls the light emission of the light-emitting unit in accordance with the timing at which a signal is received by the wireless communication unit when a light emission period included in the signal received from the other device is equal to or greater than a predetermined value, and the control unit controls the light emission of the light-emitting unit in accordance with the internal timer when the light emission period is less than the predetermined value.

(3) The light-emitting device according to (1), wherein the control unit controls the light emission of the light-emitting unit by fade-in or fade-out.

(4) The light-emitting device according to (1), further including:

an operational input unit that receives an input operation, wherein the control unit controls the light emission of the light-emitting unit in accordance with an input to the operational input unit when the wireless communication unit does not receive a signal from the other device.

(5) A method of controlling a light-emitting device, including:

performing wireless communication with another device;

determining a light emission period included in a signal received from the other device;

controlling light emission of a light-emitting unit in accordance with a timing at which a signal is received through wireless communication when the light emission period is equal to or greater than a predetermined value; and controlling the light emission of the light-emitting unit in accordance with an internal timer when the light emission period is less than the predetermined value.

(6) A program for causing a computer to execute:

performing wireless communication with another device;

determining a light emission period included in a signal received from the other device;

controlling light emission of a light-emitting unit in accordance with a timing at which a signal is received through wireless communication when the light emission period is equal to or greater than a predetermined value; and controlling the light emission of the light-emitting unit in accordance with an internal timer when the light emission period is less than the predetermined value.

The present disclosure contains subject matter related to that disclosed in Japanese Priority Patent Application JP 2012-055756 filed in the Japan Patent Office on Mar. 13, 2012, the entire content of which is hereby incorporated by reference.

What is claimed is:

1. A light-emitting device comprising:

a wireless communication unit that performs wireless communication with another device;

a light-emitting unit that emits light; and a control unit that performs control by switching between a mode in which light emission of the light-emitting unit is controlled in a low speed blinking mode based on a timing at which a signal is received by the wireless communication unit when a light emission period is equal to or greater than a predetermined value and a mode in which light emission of the light-emitting unit is controlled in a high speed blinking mode from an internal timer based on a light emission timing included in a signal received from the other device by the wireless communication unit when the light emission period is less than the predetermined value.

2. The light-emitting device according to claim 1, wherein the control unit controls the light emission of the light-emitting unit by fade-in or fade-out.

3. The light-emitting device according to claim 1, further comprising:

an operational input unit that receives an input operation, wherein the control unit controls the light emission of the light-emitting unit in accordance with an input to the operational input unit when the wireless communication unit does not receive a signal from the other device for a predetermined time.

4. A method of controlling a light-emitting device, comprising:

performing wireless communication with another device;

determining a light emission period included in a signal received from the other device;

controlling light emission of a light-emitting unit in a low speed blinking mode in accordance with a timing at which a signal is received through wireless communication when the light emission period is equal to or greater than a predetermined value; and controlling the light emission of the light-emitting unit in a high speed blinking mode in accordance with an internal timer when the light emission period is less than the predetermined value.

5. A program embodied on a non-transitory computer readable medium for causing a computer to execute:

performing wireless communication with another device;

determining a light emission period included in a signal received from the other device;

controlling light emission of a light-emitting unit in a low speed blinking mode in accordance with a timing at which a signal is received through wireless communication when the light emission period is equal to or greater than a predetermined value; and controlling the light emission of the light-emitting unit in a high speed blinking mode in accordance with an internal timer when the light emission period is less than the predetermined value.

* * * * *